US009049525B2

(12) United States Patent
Nielsen et al.

(10) Patent No.: US 9,049,525 B2
(45) Date of Patent: Jun. 2, 2015

(54) HEARING AID SYSTEM AND METHOD OF FITTING A HEARING AID SYSTEM

(71) Applicant: Widex A/S, Lynge (DK)

(72) Inventors: Jakob Nielsen, København Ø (DK); Maja Bulow, Varlose (DK); Lene Vibeke Ronkjaer Seiden, Hillerod (DK); Lene Haudrum, Taastrup (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 13/796,738

(22) Filed: Mar. 12, 2013

(65) Prior Publication Data

US 2013/0208930 A1 Aug. 15, 2013

Related U.S. Application Data

(63) Continuation-in-part of application No. PCT/EP2010/065326, filed on Oct. 13, 2010.

(51) Int. Cl.
*H04R 25/00* (2006.01)

(52) U.S. Cl.
CPC ..... *H04R 25/554* (2013.01); *H04R 25/70* (2013.01); *H04R 2225/39* (2013.01); *H04R 2460/03* (2013.01)

(58) Field of Classification Search
CPC ..... H04R 25/30; H04R 25/305; H04R 25/50; H04R 25/502; H04R 25/505; H04R 25/55; H04R 25/554; H04R 25/556; H04R 25/558; H04R 25/70; H04R 2225/39; H04R 2225/41; H04R 2225/43; H04R 2225/55; H04R 2460/03
USPC ..... 381/312–321, 23.1, 58–60; 600/559, 600/25; 700/94
See application file for complete search history.

(56) References Cited

U.S. PATENT DOCUMENTS 4,972,487 A * 11/1990 Mangold et al. ..... 381/315
5,202,927 A * 4/1993 Topholm ..... 381/315

(Continued)

FOREIGN PATENT DOCUMENTS

EP 1367857 A1 12/2003
EP 1256258 B1 3/2005

(Continued)

OTHER PUBLICATIONS

Notification of Transmittal of the International Preliminary Report on Patentability for PCT/EP2010/065326 dated Jan. 21 2013.

(Continued)

*Primary Examiner* — Curtis Kuntz
*Assistant Examiner* — Joshua A Kaufman
(74) *Attorney, Agent, or Firm* — Sughrue Mion, PLLC

(57) ABSTRACT

A hearing aid system (100) comprises a hearing aid (102) and an external device (101). The hearing aid (102) has link means for providing a wireless link with the external device (101), memory means for storing a hearing aid variable and signal processing means for initiating the logging in response to a trigger signal received from the external device (101) The external device (102) has link means (107) for providing the wireless link with the hearing aid (102), an input transducer (103) for providing an electrical audio signal, memory means (105) for storing a sample of the electrical audio signal, user input means (106) and signal processing means (104) configured for initiating the recording of the electrical audio signal sample and for initiating the transmission of the trigger signal to the hearing aid (102) in response to an activation of the user input means (106). The invention further provides a method of fitting a hearing aid system (100).

21 Claims, 2 Drawing Sheets

(56) References Cited

U.S. PATENT DOCUMENTS

| | | | | |
|---|---|---|---|---|
| 7,242,777 | B2 * | 7/2007 | Leenen et al. | 381/60 |
| 8,077,892 | B2 * | 12/2011 | Dijkstra et al. | 381/315 |
| 8,406,440 | B2 * | 3/2013 | Kidmose | 381/314 |
| 2004/0066944 | A1 * | 4/2004 | Leenen et al. | 381/314 |
| 2004/0190739 | A1 * | 9/2004 | Bachler et al. | 381/314 |
| 2005/0089183 | A1 * | 4/2005 | Niederdrank et al. | 381/312 |
| 2007/0009123 | A1 * | 1/2007 | Aschoff et al. | 381/315 |
| 2007/0076909 | A1 * | 4/2007 | Roeck et al. | 381/312 |
| 2008/0101635 | A1 * | 5/2008 | Dijkstra et al. | 381/315 |
| 2008/0107296 | A1 * | 5/2008 | Bachler et al. | 381/314 |
| 2010/0254552 | A1 * | 10/2010 | Barthel et al. | 381/314 |
| 2011/0002490 | A1 * | 1/2011 | Zukic | 381/314 |

FOREIGN PATENT DOCUMENTS

| | | | |
|---|---|---|---|
| WO | 2007/045276 | A1 | 4/2007 |
| WO | 2007/112737 | A1 | 10/2007 |
| WO | 2008/052576 | A1 | 5/2008 |

OTHER PUBLICATIONS

International Search Report for PCT/EP2010/065326 dated Jan. 20 2011.

* cited by examiner

HEARING AID SYSTEM AND METHOD OF FITTING A HEARING AID SYSTEM

RELATED APPLICATIONS

The present application is a continuation-in-part of application PCT/EP2010/065326, filed on 13 Oct. 2010, in Europe, and published as WO2012048739 A1.

BACKGROUND OF THE INVENTION

1. Field of the Invention

The present invention relates to hearing aid systems. The invention more specifically relates to hearing aid systems, comprising a hearing aid and an external device, adapted for logging of hearing aid data and sound. The invention also relates to a method of fitting a hearing aid.

In the context of the present disclosure, a hearing aid should be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

As the name suggests, Behind-The-Ear (BTE) hearing aids are worn behind the ear. To be more precise an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used because the output transducer, which in hearing aid terminology is normally referred to as the receiver, is located in the housing of the electronics unit. In some modern types of hearing aids a conducting member comprising electrical conductors is used, because the receiver is placed in the earpiece in the ear. Such hearing aids are commonly referred to as Receiver-In-The-Ear (RITE) hearing aids. In a specific type of RITE hearing aids the receiver is placed inside the ear canal. This is known as Receiver-In-Canal (RIC) hearing aids.

In-The-Ear (ITE) hearing aids are designed for arrangement in the ear, normally in the funnel-shaped outer part of the ear canal. This type of hearing aid requires a very compact design in order to allow it to be arranged in the ear canal, and to house the components necessary for operation of the hearing aid, such as microphones, a battery, a microelectronic circuit comprising a signal processor, and an acoustic output transducer.

In the context of the present disclosure, an external device should be understood as a small battery-powered microelectronic device adapted for facilitating interaction with the hearing aid.

2. The Prior Art

U.S. Pat. No. 4,972,487 discloses a hearing device that has a memory unit in which a multitude of data can be recorded.

U.S. Pat. No. 5,202,927 discloses a hearing aid system with an external device having a microphone for recording sound for subsequent analysis and evaluation by a circuit in the external device. Hereby a set of optimized control parameters corresponding to the recorded audio signal can be selected.

US-A1-2004/0190739 discloses a hearing aid having an external memory due to the limited memory size of the memory unit provided in the hearing device. It is described that acoustical signals recorded by the hearing aid microphone can be logged and stored either in the external or internal memory. It is claimed that recording of acoustical data is only possible in an external memory, due to the limited size of the internal memory and the energy supply required for maintaining a permanent recording in the hearing aid.

EP-A1-1367857 discloses a method of logging or recording input signal data of a hearing prosthesis in combination with values of one or several variables associated with the hearing prosthesis. The hearing prosthesis variable(s) may comprise logic states of a single or several user-controllable actuator(s) mounted on the prosthesis and/or values of algorithm parameters of a predetermined digital signal processing algorithm executed in the prosthesis. Hereby, error tracking and performance optimization are facilitated since anomalous or sub-optimal operating conditions of signal processing algorithms and/or user interface control handling or other undesired events may be detected. By recording both the hearing prosthesis variable or variables and the input signal data, it is e.g. possible to identify and track correlations between one or several predetermined signal events in the input signal data and effects to the operation of the hearing prosthesis derived there from.

EP-B1-1256258 discloses a method for fitting a hearing aid to the needs of a hearing aid user, the method comprising collecting statistical data characterizing physical or psychological properties of environments in which use of the hearing aid is desired and utilizing the statistical values for the adjustment of the signal processing in the hearing aid.

WO-A1-2007112737 discloses a method for use in the fitting of a hearing aid comprising the steps of providing a sound recording of a user environment, feeding the sound recording to the hearing aid as a sound input signal, processing the sound input signal according to a scheme defined by preselected settings of a number of parameters so as to provide a processed signal, adjusting the setting of at least one parameter, performing a statistical analysis of the magnitude of the processed signal or of the input signal in at least one frequency band, which statistical analysis is reset when a parameter is adjusted during the fitting, and displaying a graphical representation of the results of said statistical analysis.

One problem with the above mentioned systems and methods is that they require significantly increased hearing aid power consumption and a more bulky hearing aid design in order to provide hearing aid based sound recordings.

It is therefore a feature of the present invention to provide a hearing aid system with improved means for recording of audio samples and logging of corresponding hearing aid variables, hereby providing a hearing aid system with improved means for performance optimization without requiring a bulky design or excessive hearing aid power consumption.

Another problem with the above mentioned systems and methods is that the logged data and recorded audio sample are not presented to the hearing aid fitter in a meaningful manner.

It is therefore another feature of the present invention to provide an improved method of fitting a hearing aid system based on providing a recorded audio sample and corresponding logged hearing aid variables to a hearing aid fitting system and presenting these data to the hearing aid fitter.

SUMMARY OF THE INVENTION

The invention, in a first aspect, provides a hearing aid system comprising a hearing aid and an external device; wherein the hearing aid comprises hearing aid link means for providing a wireless link with the external device, hearing aid memory means configured for holding a first hearing aid variable, and hearing aid signal processing means configured for initiating the logging of the first hearing aid variable in response to a trigger signal transmitted from the external device; and wherein the external device comprises external device link means for providing the wireless link with the hearing aid, an external device acoustical-electrical input transducer for providing an electrical audio signal, external device memory means configured for holding a recording of an audio sample of the electrical audio signal, user input means and external device signal processing means configured for initiating the recording of the audio sample and for initiating the transmission of the trigger signal to the hearing aid in response to an activation of the user input means hereby providing time synchronization between the external device and the hearing aid and ensuring that the audio sample and the first hearing aid variable can be grouped together.

This provides a hearing aid system with improved means for recording of audio samples and logging of hearing aid variables The invention, in a second aspect, provides a method of fitting a hearing aid system comprising the steps of providing a hearing aid fitting system and a hearing aid system, said hearing aid system having a hearing aid and an external device; activating user input means accommodated in the external device of the hearing aid system; in response to the activation of the user input means recording an audio sample by an acoustical-electrical input transducer in the external device, and transmitting a trigger signal from the external device and to the hearing aid; logging a first hearing aid variable in the hearing aid in response to receiving the trigger signal from the external device, hereby providing a set of the first hearing aid variable; transmitting the audio sample from the external device and to the hearing aid fitting system; transmitting the set of the first hearing aid variable from the hearing aid and to the hearing aid fitting system; and using the hearing aid fitting system to play back the audio sample and to visually present, as a function of elapsed time, the first hearing aid variable, wherein the visual presentation and the play back of the audio sample are substantially synchronized in time.

This provides an improved method of fitting a hearing aid system based on presenting complex information to the hearing aid fitter in a comprehensible manner.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

It has been suggested within the art of hearing aid systems that it is beneficial to simultaneously record sound samples and log the corresponding hearing aid variables.

It has been suggested to store sound recordings in an external memory accommodated outside of the hearing aid. As one example it has been suggested to locate the external memory in a hearing aid system remote control.

Such systems suffer from the serious drawback that vast amounts of data comprising the recorded sound samples must be transferred from the hearing aid, where the input transducer, which picks up the sound to be recorded, is located and to the external device, where the external memory is accommodated. It is well known that wireless link means capable of transmitting such large data amounts are not easily accommodated in a normal sized hearing aid due to the requirements with respect to processing power, power consumption and component size.

Additionally it has been suggested to use a recording device for recording of sound, which can later be applied as input to a hearing aid during a hearing aid fitting in order to analyze how selected hearing aid variables respond to the recorded sound.

Such a method suffers from the drawback that the sound recording is not identical to the sound impinging on the hearing aid during the recording of the sound environment because of the different positions of the hearing aid microphones and the sound recording microphone, and it is therefore impossible to exactly mimic the hearing aid behavior that the hearing aid user has experienced in the recorded sound environment.

Another drawback is that the values of the hearing aid variables during the recording of the sound environment depend on the initial values of the hearing aid variables, i.e. the sound environment prior to the sound recording. These initial hearing aid values are unknown in case of a sound recording without corresponding logged hearing aid variables and it is therefore impossible to exactly mimic the hearing aid behavior that the hearing aid user has experienced in the recorded sound environment.

Figure 1:
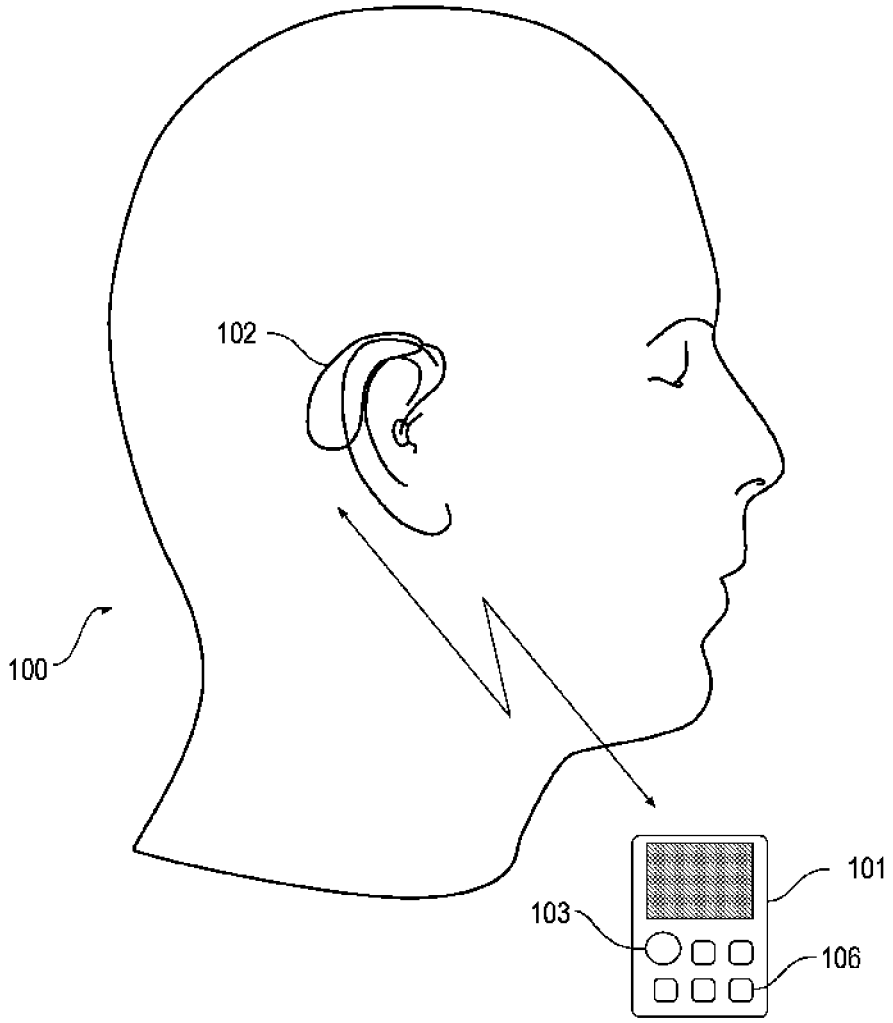
FIG. 1 illustrates highly schematically a hearing aid system according to an embodiment of the invention.

Reference is now made to FIG. 1, which illustrates highly schematically a hearing aid system 100 according to an embodiment of the invention. The hearing aid system 100 comprises an external device 101 and a hearing aid 102. The external device 101 further comprises an external device acoustical-electrical input transducer 103, user input means 106 adapted for user interaction with the external device and external device wireless link means (not shown) for providing a wireless link to the hearing aid 102.

Figure 2:
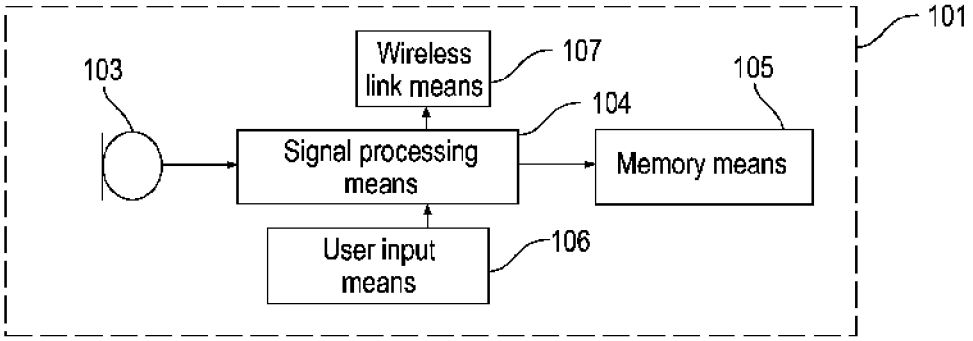
FIG. 2 illustrates highly schematically the external device of the hearing aid system according to the embodiment of FIG. 1 in greater detail.

Reference is now made to FIG. 2, which illustrates highly schematically the external device 101, according to the embodiment of FIG. 1, in greater detail. The external device 101 comprises an external device acoustical-electrical input transducer 103, external device signal processing means 104, external device memory means 105, user input means 106 for user interaction with the external device and external device wireless link means 107 for providing the wireless transmission of data to the hearing aid 102.

Generally it has been preferred, in the prior art, to avoid the use of an acoustical-electrical input transducer for the recording of an audio sample different from the acoustical-electrical input transducer of the hearing aid. However the inventors have found that the disadvantages of accommodating one acoustical-electrical input transducer in the hearing aid and accommodating another acoustical-electrical input transducer for recording the corresponding audio sample in the external device are by far outweighed by the advantages gained with respect to reduced hearing aid system complexity.

Figure 3:
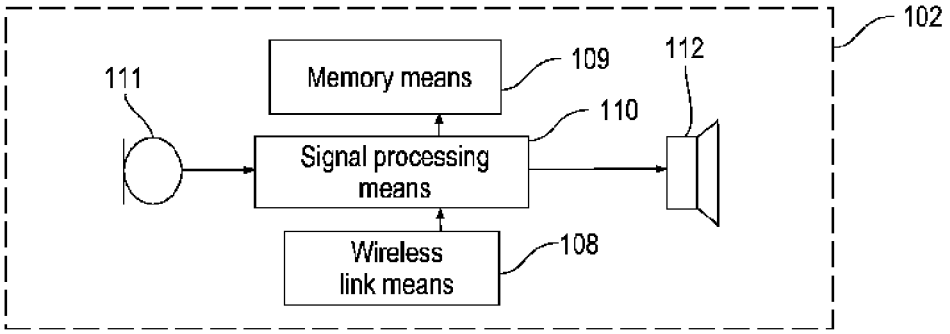
FIG. 3 illustrates highly schematically a hearing aid of the hearing aid system according to the embodiment of FIG. 1 in greater detail.

Reference is now made to FIG. 3, which illustrates highly schematically the hearing aid 102, according to the embodiment of FIG. 1, in greater detail. The hearing aid 102 comprises a hearing aid acoustical-electrical input transducer 111, hearing aid signal processing means 110, electrical-acoustical output transducer 112, hearing aid memory means 109 and hearing aid wireless link means 108 for providing the wireless link to the external device 101 of the hearing aid system 100.

The input transducer picks up the prevailing acoustic environment. The signal processing means receives a signal from the input transducer and processes it to develop a signal for the output transducer, amplified according to the user's needs. During operation the processor may receive user inputs, e.g. selection of a program or adjustment of gain, and the processor may develop a range of parameters associated with the current or the past sound environment and with the behavior of the processor.

If a wearer of the hearing aid system activates the user input means 106 accommodated in the external device 101, the external device signal processing means 104, in response hereto, initiates the recording of a sample of the electrical audio signal from the external device acoustical-electrical input transducer 103 in the external device memory means 105, time stamps the recorded sample of the electrical audio signal with an external device stamping number using external device stamping means, attaches the external device stamping number to the trigger signal to be transmitted to the hearing aid 102, and transmits the trigger signal to the hearing aid 102 using the external device wireless link means 107. When the trigger signal is received in the hearing aid 102, the hearing aid signal processing means 110, in response hereto, initiates logging of the corresponding hearing aid variables in the hearing aid memory means 109 and time stamps the logged data with the external device stamping number using hearing aid stamping means.

According to the embodiment of FIG. 1 the external device stamping number is attached to the recorded sample of the electrical audio signal and to the logged hearing aid variables. This provides a very simple method for time synchronization between the external device and the hearing aid which ensures that corresponding audio samples and hearing aid variables can be paired when the data at a later stage are read out in order to analyze and optimize the hearing aid performance.

In a variation of the embodiment of FIG. 1 the hearing aid 102 and the external device 101 both comprise a real time clock, and the time stamping of the corresponding electrical audio signal samples and hearing aid variables are performed using the real time clock.

In another variation of the embodiment of FIG. 1, the hearing aid 102 and the external device 101 exchange handshake signals in order to ensure time synchronization between the two devices. Due to the asymmetry of the available power in the hearing aid and the external device the transmission of a handshake signal from the hearing aid and to the external device will normally require that the external device is positioned in close proximity to the hearing aid during the transmission of the handshake signal, whereas this is not required when the handshake signal is transmitted from the external device and to the hearing aid.

The logged hearing aid variables may include: the active hearing aid program, output from the hearing aid classifier, the output from the acoustical-electrical input transducer accommodated in the hearing aid, the overall gain applied in the hearing aid, and the contribution to the overall gain from e.g. noise reduction, speech intelligibility enhancement, feedback cancelling and beam forming.

According to the embodiment of FIG. 1 the hearing aid variables are logged for each frequency band in the hearing aid. In variations of the embodiment of FIG. 1 the hearing aid variables are only logged for every second consecutive frequency band or only logged for the frequency bands that are most important for speech intelligibility e.g. the bands in the vicinity of 2 kHz, or the logged frequency bands are selected based on the type of hearing loss of the individual wearing the hearing aid system. In a further variation of the embodiment of FIG. 1 the hearing aid does not comprise frequency bands in the common sense, because the standard use of a filter bank (i.e. a bank of band-pass filters that separates the input signal into multiple components, each one carrying a single frequency sub band of the original signal) is replaced by a time-frequency analysis based on a fast Fourier transformation (FFT). In this variation the relevant hearing aid variables are logged for a number of FFT bins.

According to the embodiment of FIG. 1, the hearing aid variables to be logged are selected based on the individual needs of the wearer of the hearing aid system.

Typically the hearing aid variables to be logged are selected by a hearing aid fitter during a fine tuning session. The wearer of the hearing aid system will try to describe situations where the hearing aid system performance can be improved and, based on this the fitter will select the variables to be logged and program the hearing aid system accordingly.

According to the embodiment of FIG. 1, the duration of the recorded audio sample and the corresponding time span during which the hearing aid variables are logged is determined by a hearing aid fitter during a fine tuning session.

Typically the wearer of the hearing aid system is instructed to activate the user input means and initiate the data logging and sound recording whenever the hearing aid wearer is in a situation where the user feels that the hearing aid system performance can be improved.

In a variation of the embodiment of FIG. 1, the external device comprises an external device circular buffer configured to continuously hold a sample of the electrical audio signal picked up by the external device acoustical-electrical input transducer, and the hearing aid comprises a hearing aid circular buffer configured to hold a consecutive set of the hearing aid variables to be logged. Whenever the wearer of the hearing aid system activates the user input means, the content of the external device circular buffer is stored in the external device memory means, and the content of the hearing aid circular buffer is stored in the hearing aid memory means when the hearing aid receives the trigger signal from the external device. Hereby the user can log data and record sound for a situation that has already occurred instead of trying to predict when a difficult situation will arise where the user feels that the hearing aid system performance can be improved. In a further variation of the embodiment of FIG. 1 the hearing aid system is configured to allow the user to deactivate the continuous storing of data in the circular buffers. Hereby the required processing power of the hearing aid system can be significantly reduced in sound environments where it is unlikely that a difficult situation will arise. An example of such a sound environment could be when the wearer of the hearing aid system sits quietly at home.

Figure 4:
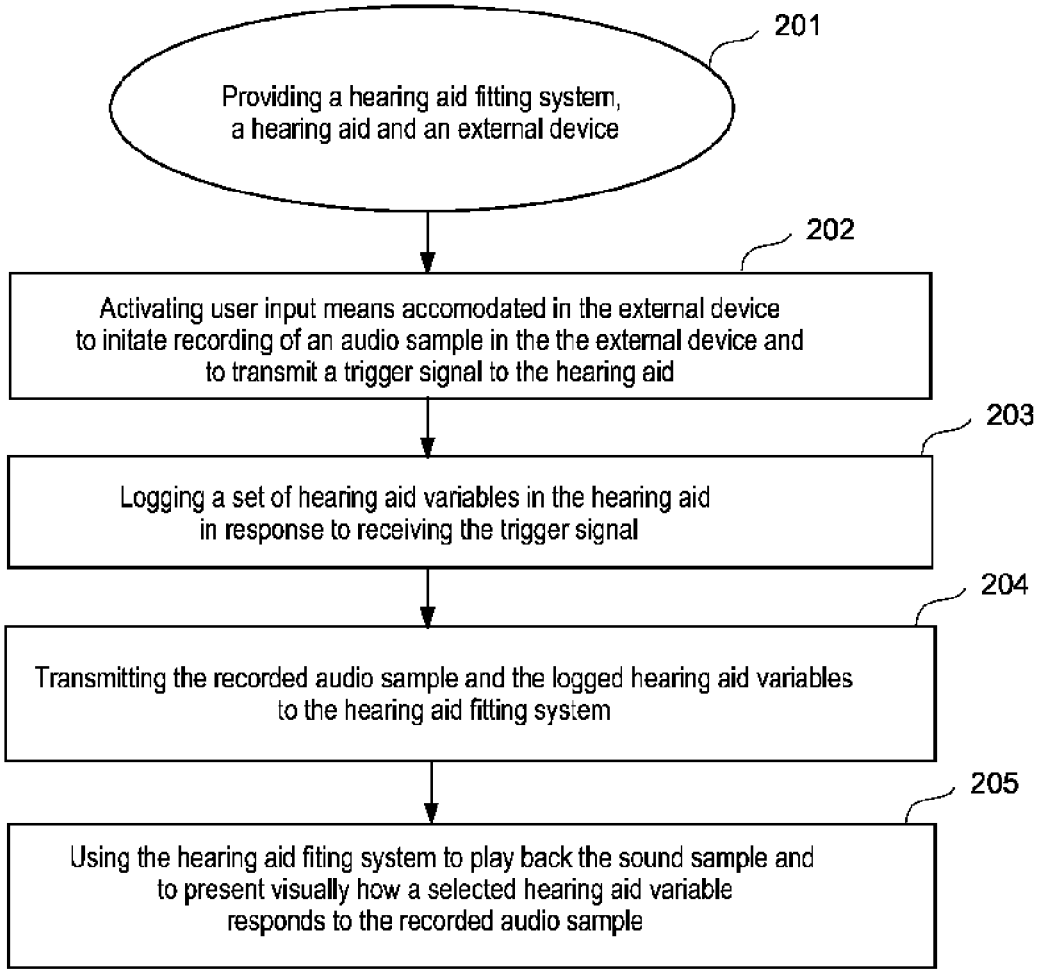
FIG. 4 illustrates a flow diagram according to a method embodiment of the invention.

Reference is now made to FIG. 4, which illustrates highly schematically a flow diagram of a method for logging of data and sound and for performance optimization of a hearing aid system according to a method embodiment of the invention. In a first step 201 a hearing aid, an external device and a hearing aid fitting system is provided. In a second step 202 user input means accommodated in the external device are activated in order to initiate recording of a sound sample in the external device and to transmit a trigger signal to the hearing aid. In a third step 203 a set of hearing aid variables are logged in the hearing aid in response to receiving the trigger signal. In a fourth step 204 the recorded sound sample and the logged hearing aid variables are transmitted to the hearing aid fitting system. In the fifth and final step 205 the hearing aid fitting system is used to play back the recorded audio sample and to present visually, as a function of elapsed time, how a selected hearing aid variable correlates to the recorded audio sample, wherein the visual presentation and the play back of the audio sample are substantially synchronized in time.

The inventive combination of a visual presentation of the logged hearing aid variables with an audio presentation of the corresponding recorded audio sample solves the problem of presenting the audio sample (i.e. the sound environment) to the hearing aid fitter in a manner that is both comprehensible and comprises sufficient details.

Hereby the hearing aid fitter is provided with a valuable tool that can help the hearing aid fitter improve the performance of the hearing aid system through a fine adjustment of the hearing aid settings.

In a variation of the embodiment of FIG. 4, two selected hearing aid variables are presented visually in the same graph, as a function of elapsed time. In another variation of FIG. 4 one of the two selected hearing aid variables is a statistical representation of the sound environment that has been recorded in the audio sample. An example of such a hearing aid variable is a 90% percentile.

Hereby the hearing aid fitter is provided with further improved means for comprehending the sound environment the hearing aid user has recorded, because the sound environment is presented in an audio-visual manner.

According to the embodiment of FIG. 1 an audio sample with duration in the range of 20 to 30 seconds is recorded. It has been found that an audio sample with a duration in the range of 20 to 30 seconds presents a reasonable compromise between on one hand the desire to minimize the memory requirements for the hearing aid system and on the other hand the desire to improve as much as possible the hearing aid performance through a fine adjustment of the hearing aid settings.

In a variation of the embodiment of FIG. 1, the audio sample has duration of at least 10 seconds, which is in most cases sufficient for allowing the hearing aid fitter to analyze how the hearing aid has responded to this specific sound environment and to suggest improvements of the hearing aid settings. It has also been found that audio samples with duration of more than 1 minute do not add significantly to the quality of the analysis and the derived suggestions for improvements of the hearing aid settings.

According to the embodiment of FIG. 1 the audio sample is recorded with a sampling frequency corresponding to two times the spectral bandwidth of the hearing aid, in accordance with the Nyquist-Shannon sampling theorem.

According to the embodiment of FIG. 1 the hearing aid variables are logged with a sample frequency in the range between 0.5 and 5 Hz. It has been found that this relatively slow sampling can provide a graphical presentation with sufficient temporal resolution to allow the hearing aid fitter to analyze how the hearing aid has responded to the recorded audio sample and to suggest improvements of the hearing aid settings for that type of sound environment. In a variation of the embodiment of FIG. 1 a sampling frequency in the range between 20 and 25 Hz is selected in order to ensure a graphical presentation that is similar to that of a normal movie. In another variation of the embodiment of FIG. 1 the sampling frequency is selected depending on the temporal behavior of the hearing aid variables to be logged. Hereby one hearing aid variable can be sampled with a relatively low frequency, while another hearing aid variable can be sampled with a relatively high frequency. As an example hearing aid variables such as active hearing aid program, hearing aid classifier output and volume control off-set are only logged once, whereas e.g. the various gain variables typically will be sampled with a relatively high sampling frequency.

The recorded sound sample and the logged hearing aid variables can be transmitted to the hearing aid fitting system using a variety of methods that are all well known within the art. According to the method embodiment of FIG. 3 the data are transmitted directly from the hearing aid system and to the hearing aid fitting system during a follow up visit to the hearing aid fitter. In a variation of the method embodiment according to FIG. 3 the data are first transmitted to a device, that is connected to the internet, and from there transmitted, via the internet, to the hearing aid fitting system of the hearing aid fitter.

Other modifications and variations of the structures and procedures will be evident to those skilled in the art.

We claim:

1. A hearing aid system comprising a hearing aid and an external device; wherein the hearing aid comprises a hearing aid link component for providing a wireless link with the external device, a hearing aid memory configured for holding a first hearing aid variable, and hearing aid signal processor configured for initiating the logging of the first hearing aid variable in response to a trigger signal transmitted from the external device; and the external device comprises an external device link component for providing the wireless link with the hearing aid, an external device acoustical-electrical input transducer for providing an electrical audio signal, an external device memory configured for holding a recording of an audio sample of the electrical audio signal, a user input and an external device signal processor configured for initiating the recording of the audio sample and for initiating the transmission of the trigger signal to the hearing aid in response to an activation of the user input thereby providing time synchronization between the external device and the hearing aid and ensuring that the audio sample and the first hearing aid variable can be grouped together.

2. The hearing aid system according to claim 1; wherein the external device comprises an external device stamping component configured to attach an external device stamping number to the recorded audio sample and to the trigger signal transmitted to the hearing aid; and the hearing aid comprises a hearing aid stamping component configured to attach the external device stamping number to the data logged in response to receiving the trigger signal comprising the external device stamping number.

3. The hearing aid system according to claim 1, wherein the external device comprises an external device circular buffer configured to hold data representing the electrical audio signal picked up by the external device acoustical-electrical input transducer;

the hearing aid comprises a hearing aid circular buffer configured to hold at least a set of the first hearing aid variable;

the external device signal processor is configured to record the audio sample in the external device memory by transferring the data representing the electrical audio signal from the external device circular buffer and to the external device memory; and the hearing aid signal processor is configured to initiate logging of the first hearing aid variable in the hearing aid memory by transferring the consecutive set of the first hearing aid variable from the hearing aid circular buffer and to the hearing aid memory.

4. A method of fitting the hearing aid system according to claim 1, said method comprising the steps of:

activating said user input;

in response to the activation of the user input, recording an audio sample by said acoustical-electrical input transducer in the external device, and transmitting said trigger signal from the external device and to the hearing aid;

logging said first hearing aid variable in the hearing aid in response to receiving the trigger signal from the external device, thereby providing a variable set including the first hearing aid variable;

transmitting the audio sample from the external device and to the hearing aid fitting system;

transmitting the variable set from the hearing aid to the hearing aid fitting system; and using the hearing aid fitting system to play back the audio sample and to visually present, as a function of elapsed time, the first hearing aid variable, wherein the visual presentation and the play back of the audio sample are substantially synchronized in time.

5. The hearing aid system according to claim 1, wherein said recording is of a duration between 10 seconds and 60 seconds.

6. The hearing aid system according to claim 1, wherein said recording is of a duration between 20 seconds and 30 seconds.

7. The hearing aid system according to claim 1, wherein said hearing aid memory stores a plurality of samples of said hearing aid parameter taken at a sampling rate of between 0.5 Hz and 25 Hz.

8. The hearing aid system according to claim 7, wherein said parameter sampling rate is between 0.5 Hz and 5 Hz.

9. The hearing aid system according to claim 7, wherein said parameter sampling rate is between 20 Hz and 25 Hz.

10. The hearing aid system according to claim 7, wherein said hearing aid memory stores samples of a plurality of different hearing aid parameters, with at least two of said parameters having different sampling rates.

11. A method of fitting a hearing aid system comprising the steps of:

providing a hearing aid fitting system and a hearing aid system, said hearing aid system having a hearing aid and an external device;

activating a user input accommodated in the external device of the hearing aid system;

in response to the activation of the user input recording an audio sample by an acoustical-electrical input transducer in the external device, and transmitting a trigger signal from the external device and to the hearing aid;

logging a first hearing aid variable in the hearing aid in response to receiving the trigger signal from the external device, thereby providing a variable set including the first hearing aid variable;

transmitting the audio sample from the external device and to the hearing aid fitting system;

transmitting the variable set from the hearing aid to the hearing aid fitting system; and using the hearing aid fitting system to play back the audio sample and to visually present, as a function of elapsed time, the first hearing aid variable, wherein the visual presentation and the play back of the audio sample are substantially synchronized in time.

12. The method according to claim 11 comprising the steps of:

logging a second hearing aid variable in the hearing aid in response to receiving the trigger signal from the external device; and using the hearing aid fitting system to visually present, as a function of elapsed time, the second hearing aid variable together with the first hearing aid variable; wherein the second hearing aid variable is a statistical representation of the sound environment.

13. The method according to claim 12, wherein the second hearing aid variable is a 90% percentile.

14. The method according to claim 11 comprising the steps of:

attaching an external device stamping number to the recorded audio sample;

attaching the external device stamping number to the trigger signal;

attaching the external device stamping number to the data logged in response to receiving the trigger signal from the external device; and grouping the recorded audio sample and the logged data together based on the attached external device stamping number.

15. The method according to claim 11 comprising the steps of:

storing continuously data representing an electrical audio signal picked up by an external device acoustical-electrical input transducer in an external device circular buffer;

storing continuously the first hearing aid variable in a hearing aid circular buffer, to thereby provide said variable set;

wherein the step of recording an audio sample in the external device in response to the activation of the user input comprises transferring the data representing the audio signal sample from the external device circular buffer to the external device memory;

and wherein the step of logging a first hearing aid variable in response to receiving the trigger signal from the external device comprises transferring the variable set from the hearing aid circular buffer to the hearing aid memory.

16. The method according to claim 11, wherein said recording is of a duration between 10 seconds and 60 seconds.

17. The method according to claim 11, wherein said recording is of a duration between 20 seconds and 30 seconds.

18. The method according to claim 11, wherein said logging step comprises logging a plurality of samples of said hearing aid parameter taken at a parameter sampling rate of between 0.5 Hz and 25 Hz.

19. The method according to claim 18, wherein said parameter sampling rate is between 0.5 Hz and 5 Hz.

20. The method according to claim 18, wherein said parameter sampling rate is between 20 Hz and 25 Hz.

21. The method according to claim 11, wherein said logging step comprises logging samples of a plurality of different hearing aid parameters, with at least two of said parameters having different sampling rates.

* * * * *